US007415344B2

(12) United States Patent
Kawai

(10) Patent No.: US 7,415,344 B2
(45) Date of Patent: Aug. 19, 2008

(54) CONTROL APPARATUS AND METHOD FOR INTERNAL COMBUSTION ENGINE

(75) Inventor: Tomoya Kawai, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/905,681

(22) Filed: Oct. 3, 2007

(65) Prior Publication Data

US 2008/0091331 A1 Apr. 17, 2008

(30) Foreign Application Priority Data

Oct. 11, 2006 (JP) ..... 2006-277856

(51) Int. Cl.
*F02D 28/00* (2006.01)

(52) U.S. Cl. ..... 701/102

(58) Field of Classification Search ..... 701/102, 701/110, 114, 115
See application file for complete search history.

(56) References Cited

FOREIGN PATENT DOCUMENTS

| | | | |
|---|---|---|---|
| JP | A-3-182667 | | 12/1989 |
| JP | A 03-182667 | | 8/1991 |
| JP | 5-107153 | A * | 4/1993 |
| JP | A-11-82090 | | 9/1997 |
| JP | A 11-082090 | | 3/1999 |
| JP | 2004-316811 | A * | 11/2004 |

* cited by examiner

*Primary Examiner*—Hieu T Vo
(74) *Attorney, Agent, or Firm*—Oliff & Berridge, PLC

(57) ABSTRACT

A required torque waveform, a target torque waveform, and a maximum torque that can be realized/achieved by hardware are updated at time t2. When a required torque value at time t2 exceeds the maximum torque, the time at which the target torque waveform is realized is delayed until time tb at which this required torque value matches the maximum torque.

6 Claims, 4 Drawing Sheets

CONTROL APPARATUS AND METHOD FOR INTERNAL COMBUSTION ENGINE

INCORPORATION BY REFERENCE

The disclosure of Japanese Patent Application No. 2006-277856 filed on Oct. 11, 2006, including the specification, drawings and abstract is incorporated herein by reference in its entirety.

BACKGROUND OF THE INVENTION

1. Field of the Invention

The invention relates to a control apparatus and method for an internal combustion engine. More particularly, the invention relates to a control apparatus and method that realizes a target waveform of a torque produced by an internal combustion engine.

2. Description of the Related Art

Japanese Patent Application Publication No. 11-82090 (JP-A-11-82090) describes an apparatus which calculates a target torque based on an accelerator pedal operation amount and determines an intake air amount, an ignition timing, and the like so as to achieve that target torque. In addition, Japanese Patent Application Publication No. 3-182667 (JP-A-3-182667) describes other related art.

However, if an internal combustion engine is required to significantly increase or decrease the torque production amount in a short time, the target torque may fall outside a range of torque that can be achieved by controlling the throttle valve opening amount, the ignition timing, and the like. In such case, it may no longer be possible to realize the target torque waveform. That is, the degree of accuracy at which the target torque waveform matches the required torque wave form may be reduced.

SUMMARY OF THE INVENTION

This invention provides a control apparatus and method for an internal combustion engine, which can realize a target torque waveform, even when the internal combustion engine is required to significantly increase or decrease the torque production amount in a short time.

A first aspect of the invention relates to a control apparatus for an internal combustion engine. This control apparatus includes: a torque varying unit that changes torque output from the internal combustion engine; a target torque waveform updating unit that updates a target torque waveform in response to an accelerator operation; a torque range determining unit that determines a torque range that is a range of torque which can be achieved by the torque varying unit; and a realization time delaying unit that delays a time at which the target torque waveform is realized until the target torque waveform falls within the torque range, when the target torque waveform updated by the target torque waveform updating unit falls outside the torque range.

According to the first aspect of the invention, the time at which the target torque waveform is realized is delayed, when the updated target torque waveform falls outside the range of torque that can be achieved by the torque varying unit. As a result, the target torque waveform can be brought within the torque range so that the target torque waveform can be realized using the torque varying unit. Accordingly, the target torque waveform can be realized, even when the internal combustion engine is required to significantly increase or decrease the torque production amount in a short time.

The control apparatus according to the first aspect of the invention may further include: a delay time calculating unit that calculates a delay time that is a delay in the time at which the target torque waveform is realized; and a prohibiting unit that prohibits the time at which the target torque waveform is realized from being delayed by the realization time delaying unit, when the delay time exceeds a predetermined reference value.

With the configuration described above, the time at which the target torque waveform is realized is prohibited from being delayed, when the delay time exceeds the predetermined reference value. As a result, it is possible to avoid a situation in which an unpleasant sensation is imparted to the driver of the vehicle.

A second aspect of the invention relates to a control method for an internal combustion engine, which controls torque output from the internal combustion engine. The control method includes: setting a target torque waveform in response to an accelerator operation; determining a torque range which is a range of achievable torque; and delaying a time at which the target torque waveform is realized until the target torque waveform falls within the torque range, when the set target torque waveform falls outside the torque range.

The control method according to the second aspect of the invention may further include: calculating a delay time that is a delay in the time at which the target torque waveform is realized; and prohibiting the time at which the target torque waveform is realized from being delayed when the delay time exceeds a predetermined reference value.

BRIEF DESCRIPTION OF THE DRAWINGS

The foregoing and further objects, features and advantages of the invention will become apparent from the following description of an example embodiment with reference to the accompanying drawings, wherein like numerals are used to represent like elements and wherein.

DETAILED DESCRIPTION OF THE EMBODIMENT

Figure 1:
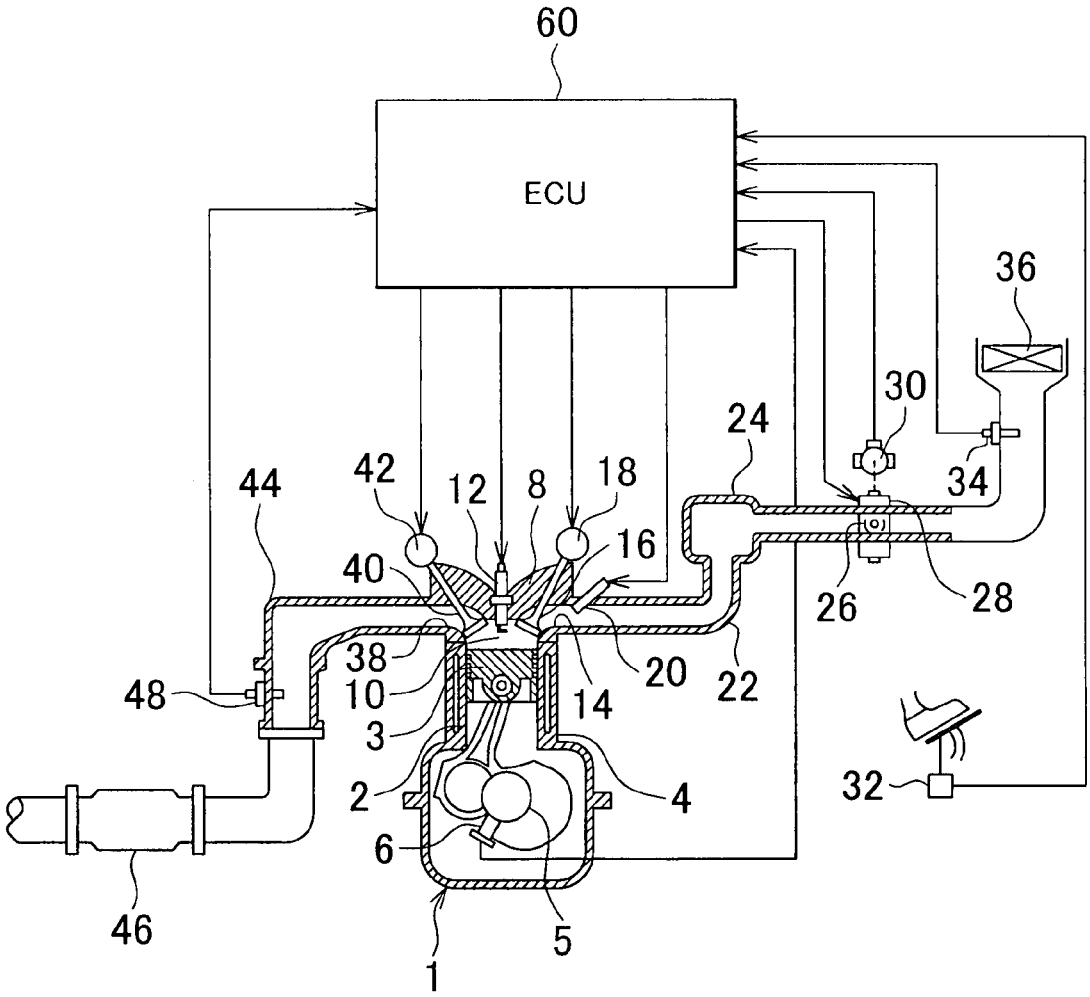
FIG. 1 is a view schematically showing the structure of a system according to one example embodiment of the invention.

Hereinafter, an example embodiment of the invention will be described in detail with reference to the accompanying drawings. In the following description, common elements in the drawings will be denoted by like reference numerals and detailed descriptions of those elements will not be repeated.

FIG. 1 is a view schematically showing the structure of a system according to one example embodiment of the invention. The system according to this example embodiment of the invention includes an internal combustion engine 1 that has a plurality of cylinders 2, only one of which is shown in the drawing. In the following description, those elements provided in plurality but of which only one is shown in the drawings, such as the cylinders 2 described above, as well as pistons, valves, and the like, which will be described below, will generally be described in the singular in order to simplify the description.

The internal combustion engine 1 also has a cylinder block 4 in which a piston 3 is housed. The piston 3 is connected to a crankshaft 5 via a crank mechanism. A crank angle sensor 6 is provided near the crankshaft 5. This crank angle sensor 6 detects a rotation angle (i.e., crank angle CA) of the crankshaft 5.

A cylinder head 8 is assembled onto the top face of the cylinder block 4. A combustion chamber 10 is formed in the space between the upper surface of the piston 3 and the cylinder head 8. A spark plug 12 that ignites an air-fuel mixture in the combustion chamber 10 is provided in the cylinder head 8.

The cylinder head 8 also has an intake port 14 which is communicated with the combustion chamber 10. An intake valve 16 is provided in a connecting portion where the intake port 14 is connected to the combustion chamber 10. This intake valve 16 is connected to a variable valve timing mechanism 18 which is well known. The variable valve timing mechanism 18 is, for example, an electromagnetically-controlled valve drive mechanism which is structured so as be able to change the manner in which the intake valve 16 opens.

An intake passage 22 is connected to the intake port 14. A fuel injector 20 that injects fuel toward the intake port 14 of the intake passage 22 is provided near the intake port 14. A surge tank 24 is provided upstream of the fuel injector 20. A throttle valve 26 is provided upstream of the surge tank 24. The throttle valve 26 is an electronically-controlled valve that is driven by a throttle motor 28. The throttle valve 26 is driven based on an accelerator angle AA that is detected by an accelerator angle sensor 32. A throttle opening amount sensor 30 that detects a throttle opening amount TA is provided near the throttle valve 26.

An airflow meter 34 is provided upstream of the throttle valve 26. The airflow meter 34 detects an intake air flow-rate Ga. An air cleaner 36 is provided upstream of the airflow meter 34.

The cylinder head 8 also has an exhaust port 38 that is communicated with the combustion chamber 10. An exhaust valve 40 is provided in a connecting portion where the exhaust port 38 is connected to the combustion chamber 10. This exhaust valve 40 is connected to a variable valve timing mechanism 42 which is well known. The variable valve timing mechanism 42 is, for example, an electromagnetically-controlled valve drive mechanism which is structured so as be able to change the manner in which the exhaust valve 40 opens. An exhaust passage 44 is connected to the exhaust port 38. An exhaust gas control catalyst 46 that purifies exhaust gas is provided in the exhaust passage 44. This exhaust gas control catalyst 46 is a three-way catalyst, for example. An air-fuel ratio sensor 48 that detects the air-fuel ratio of the exhaust gas is provided upstream of the exhaust gas control catalyst 46.

Also, the system according to this example embodiment of the invention includes an ECU (Electronic Control Unit) 60 which serves as a control apparatus. The spark plug 12, the fuel injector 20, the variable valve timing mechanisms 18 and 42, the throttle motor 28, and, the like are connected to the ECU 60, and control signals are transmitted from the ECU 60 to these components. The crank angle sensor 6, the throttle opening amount sensor 30, the accelerator angle sensor 32, the airflow meter 34, the air-fuel ratio sensor 48, and the like are connected to the ECU 60, and the ECU 60 receives signals from these components. The ECU 60 collectively controls the internal combustion engine 1 by executing fuel injection control, ignition timing control, etc. based on the signals from the various sensors. The ECU 60 also calculates an engine speed NE based on the signal from the crank angle sensor 6, as well as calculates the torque required of the internal combustion engine 1 based on the accelerator angle AA, the throttle opening amount TA, and the like.

With the system described above, the required torque is determined based on the accelerator angle AA, and control over various hardware is executed in order to achieve this required torque.

Figure 2:
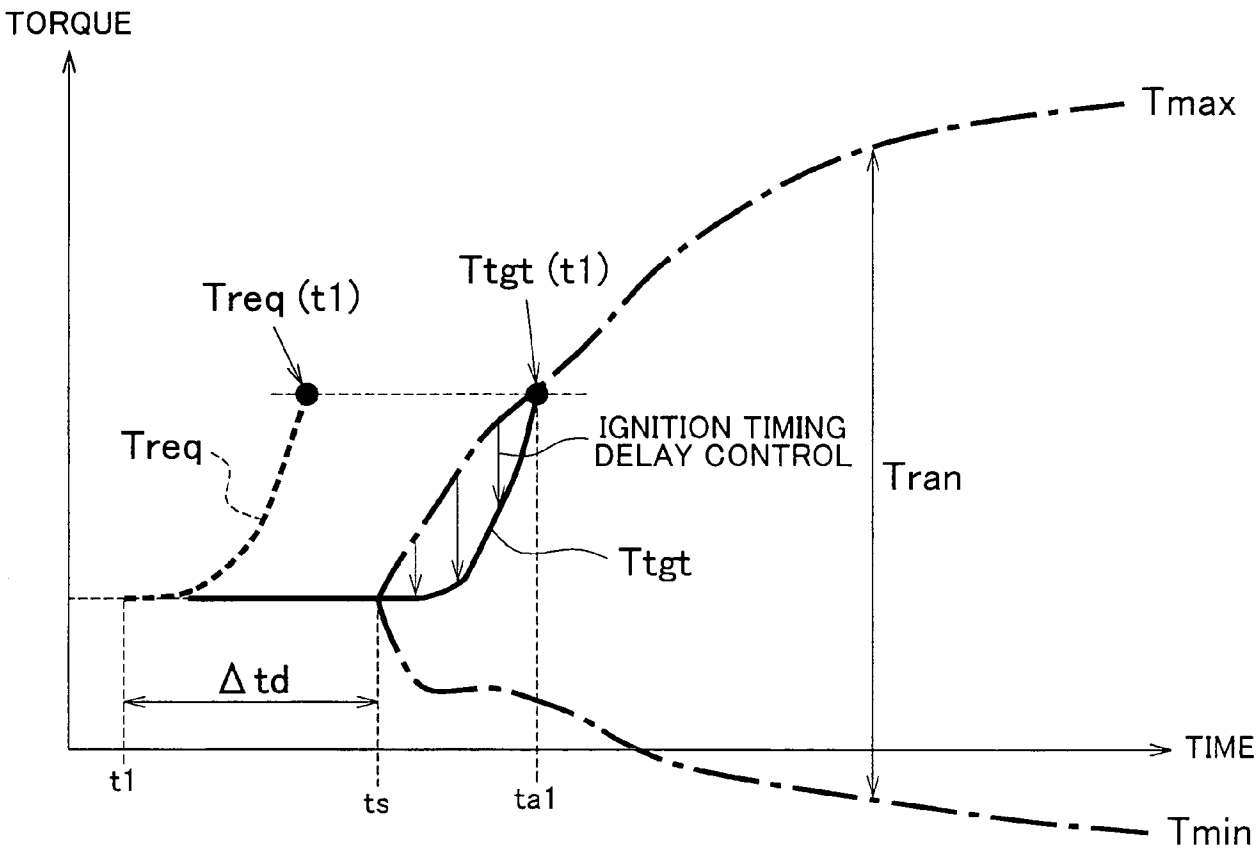
FIG. 2 is a graph showing a required torque waveform updated at time t1 and a target torque waveform.

FIG. 2 is a graph showing a required torque waveform Treq updated at time t1 and a target torque waveform Ttgt. In the graph, the horizontal axis represents time and the vertical axis represents torque.

In FIG. 2, reference character Treq denotes the required torque waveform updated at time t1 and reference character Treq (t1) denotes the value of torque required (hereinafter, referred to as the "required torque value") at time t1. Also, reference character Ttgt denotes the target torque waveform for realizing the required torque waveform and reference character Ttgt (t1) denotes the target torque value for achieving the required torque value Treq (t1) at time t1. Moreover, reference characters Tmax and Tmin denote the maximum torque and the minimum torque, respectively, that can be achieved by controlling the hardware from time t1. The region between the maximum torque Tmax and the minimum torque Tmin is a range of torque that can be achieved by hardware control.

As shown in FIG. 2, the required torque value Treq (t1) is determined in response to an accelerator operation (i.e., depression of the accelerator in this example embodiment of the invention) at time t1 and the required torque waveform Treq is updated. Hardware control is executed in order to realize this required torque waveform Treq. The maximum torque (also referred to as the "upper limit torque") Tmax that can be achieved by this hardware control starts to rise at time ts. For example, when the throttle opening amount TA is controlled to the maximum opening amount and the ignition timing is controlled to MBT (minimum advance for the best torque), the maximum torque Tmax can be achieved from time ts. A delay time Δtd from time t1 to time ts is a time lag between when the control is started and when the maximum torque Tmax is initially achieved. Such time lag is caused due to a delay in response of the intake air to the control, and has a correlation with the volume of the intake port 14 and the volume of a portion of the intake passage 22, which is positioned downstream of the throttle valve 26. The delay time Δtd is, for example, 100 milliseconds.

A target torque waveform Ttgt is determined such that the target torque value Ttgt (t1) corresponding to the required torque value Treq (t1) matches that maximum torque Tmax. Here, the maximum torque Tmax is achieved when the throttle opening amount TA is controlled to the maximum opening amount and the ignition timing is controlled to MBT (minimum advance for the best torque) after time t1. Accordingly, during the period from time ts until time ta1 at which the target torque value Ttgt (t1) matches the maximum torque Tmax, a target torque waveform Ttgt that indicates a torque smaller than the maximum torque Tmax at any given time point can be realized by controlling the throttle opening amount TA to the maximum opening amount and controlling the ignition timing so that it is delayed with respect to MBT.

Figure 3:
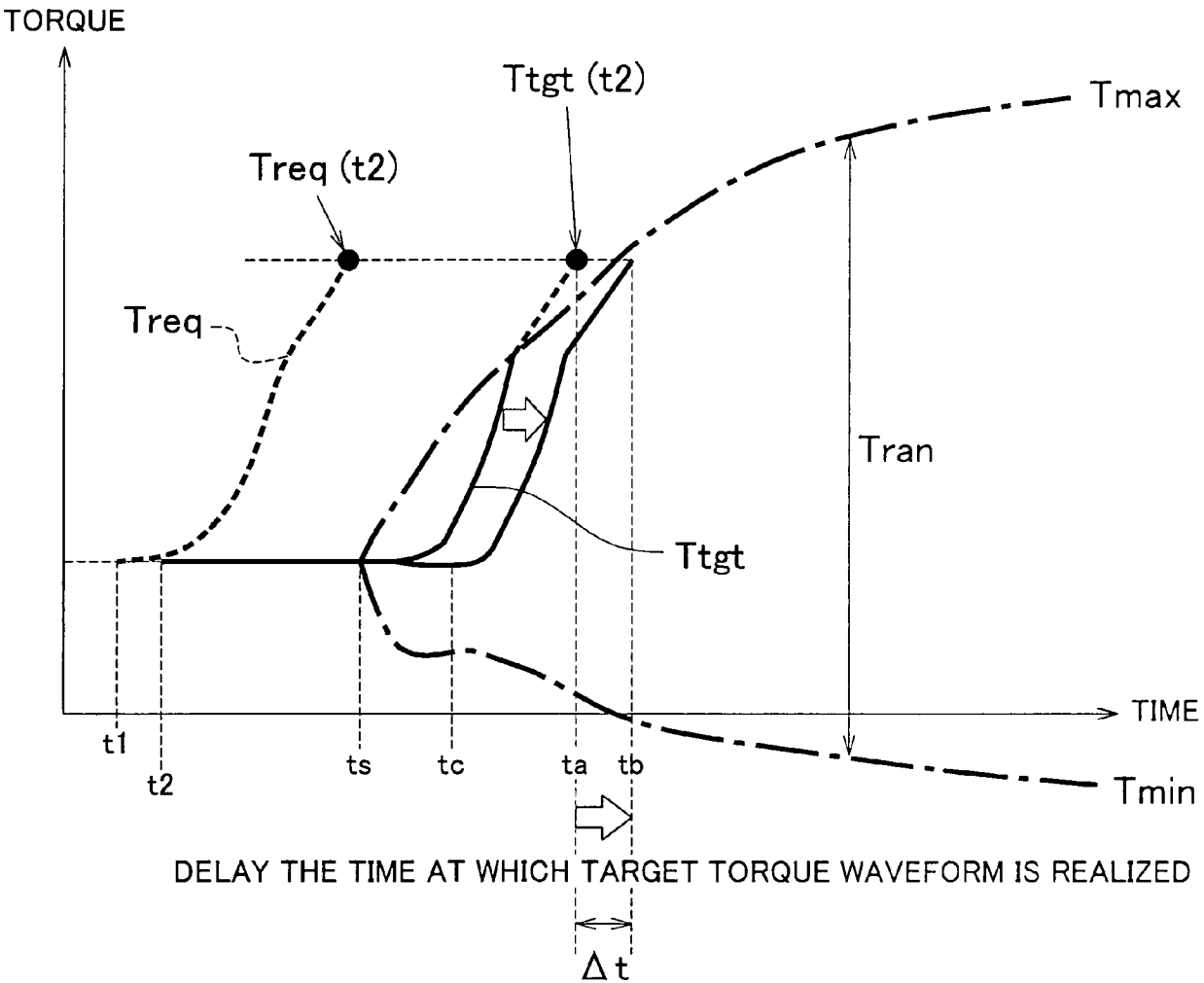
FIG. 3 is a graph showing control for realizing the target torque waveform updated at time t2.

In some cases, before the target torque waveform Ttgt shown in FIG. 2 is realized, the internal combustion engine 1 is required to generate an additional torque by an accelerator operation at time t2 (see FIG. 3), which is performed in addition to the accelerator operation at time t1 described above. FIG. 3 is a graph showing control for realizing the target torque waveform Ttgt updated at time t2. In the graph in FIG. 3, just as in the graph in FIG. 2, the horizontal axis represents time and the vertical axis represents torque.

As shown in FIG. 3, the required torque value Treq (t2) is determined in response to the accelerator operation at time t2 and the required torque waveform Treq is updated. The target torque waveform Ttgt is also updated so as to correspond to this updated required torque waveform Treq.

However, when the internal combustion engine 1 is required to produce a large amount of additional torque in a short time, the target torque waveform Ttgt may fall outside a range Tran of torque that can be achieved (hereinafter this range may also be referred to as the "achievable torque range Tran") by hardware control. A portion of the target torque waveform Ttgt, which falls outside this achievable torque range Tran, is shown by a bold broken line in FIG. 3. This bold broken line portion includes a target torque value Ttgt (t2) that corresponds to the required torque value Treq (t2). In such a case, the target torque waveform Ttgt is no longer able to be realized. At time t1, the accelerator operation at time t2 is not predicted. Accordingly, a situation may arise in which the target torque waveform Ttgt updated at time t2 is no longer able to be realized.

In this example embodiment of the invention, after updating the target torque waveform Ttgt in response to the accelerator operation at time t2, it is determined whether the target torque value Ttgt (t2) exceeds the maximum torque Tmax. If the target torque value Ttgt (t2) does not exceed the maximum torque Tmax, the target torque waveform Ttgt updated at time t2 can be realized by executing the throttle opening amount TA control and the ignition timing control described above.

If, on the other hand, the target torque value Ttgt (t2) exceeds the maximum torque Tmax, the target torque waveform Ttgt updated at time t2 is unable to be realized. That is, the target torque waveform Ttgt is unable to be realized even if the throttle opening amount control and the ignition timing control described above are executed.

In order to avoid such a situation, the time at which the target torque waveform Ttgt is realized is delayed until the target torque waveform Ttgt falls within the achievable torque range Tran, according to the embodiment of the invention. That is, the time at which the target torque value Ttgt (t2) is achieved is delayed until the target torque value Ttgt (t2) on the target torque waveform Ttgt matches the maximum torque Tmax. As a result, the time at which the target torque waveform Ttgt is realized is delayed with respect to the time at which the target torque waveform Ttgt updated at time t2 would be realized. In the example shown in FIG. 3, the time at which the target torque value Ttgt (t2) is achieved is changed from time ta to time tb. During a period from time ts at which the maximum torque Tmax starts to rise until time tb, the target torque waveform Ttgt is realized by delaying the ignition timing with respect to MBT while maintaining the throttle opening amount TA at the maximum opening amount.

In this way, theoretically, the target torque waveform Ttgt can reliably be realized by delaying the time at which the target torque waveform Ttgt updated at time t2 is realized, i.e., the time at which the target torque value Ttgt (t2) is achieved, from time ta to time tb. However, when time tb is much later than time ta, i.e., when the difference between the delayed target torque waveform Ttgt and the required torque waveform Treq on the time axis is significantly large, an unpleasant sensation may be imparted to the driver of the vehicle.

Therefore, a delay time Δt from time ta at which the updated target torque waveform Ttgt is realized until time tb that the delayed target torque waveform Ttgt is realized is calculated. When this delay time Δt exceeds a reference value $\Delta t_{th}$, the time at which the target torque waveform Ttgt is realized is prohibited from changing from time ta to time tb. Accordingly, a portion of the target torque waveform Ttgt, which is up to the target torque value Ttgt (t1) that matches the maximum torque Tmax, can be realized, although the target torque waveform Ttgt does not entirely match the required torque waveform Treq. As a result, the driver of the vehicle is able to feel some degree of acceleration, which suppresses the unpleasant sensation imparted to the driver.

Figure 4:
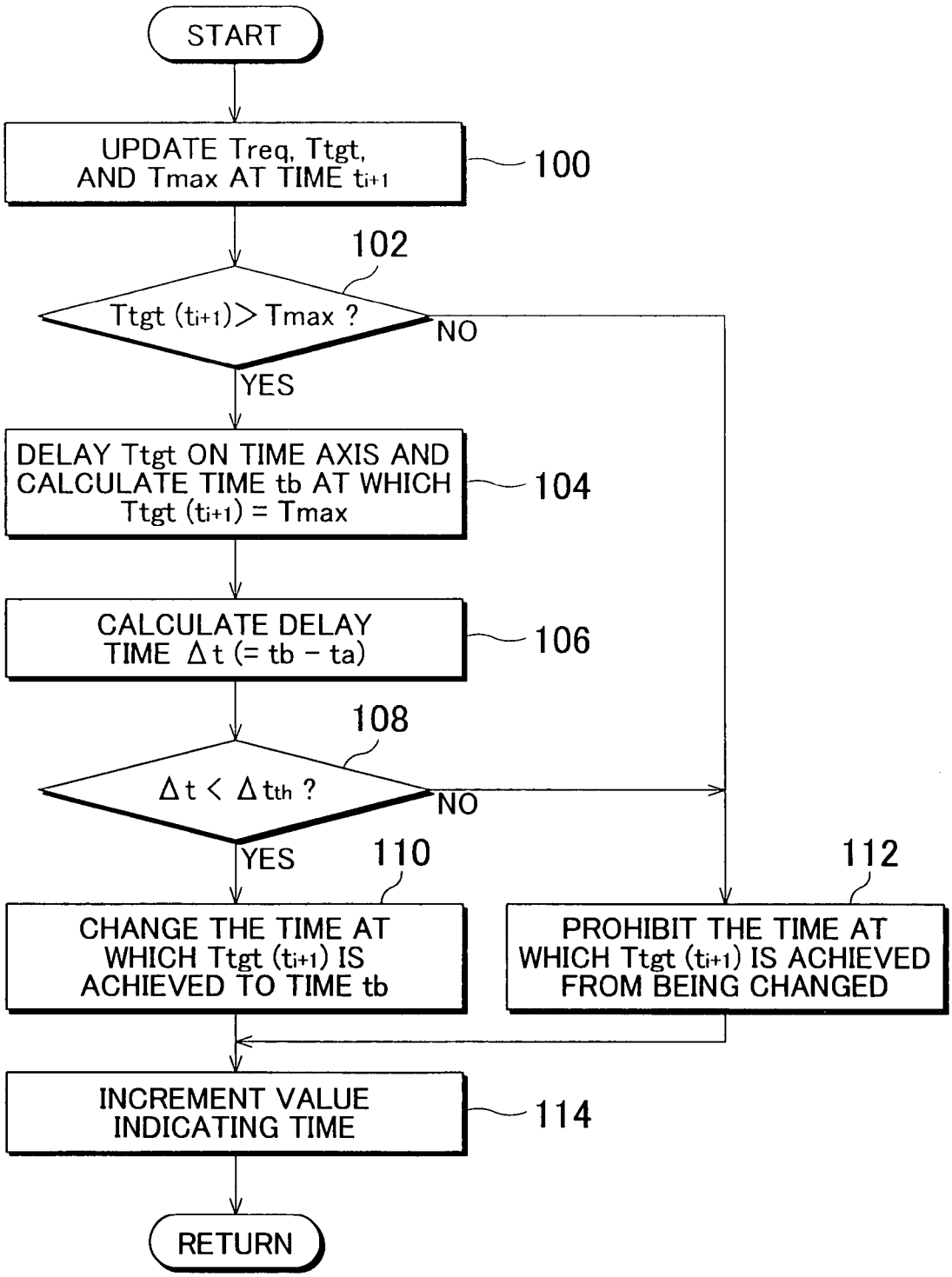
FIG. 4 is a flowchart illustrating a routine that is executed by an ECU according to the example embodiment of the invention.

FIG. 4 is a flowchart illustrating a routine that is executed by the ECU 60 according to this example embodiment of the invention. According to the routine shown in FIG. 4, first, the required torque waveform Treq, the target torque waveform Ttgt, and the maximum torque Tmax are updated based on the accelerator angle AA at time $t_{i+1}$ (step 100).

In step 100, first, a required torque value ($t_{i+1}$) is calculated based on the accelerator angle AA at time $t_{i+1}$ using a map or a function expression. The required torque waveform Treq is then updated at time $t_{i+1}$ based on this required torque value ($t_{i+1}$) and the required torque waveform Treq at time $t_i$ before the update. Then the target torque value ($t_{i+1}$) that corresponds to the required torque value ($t_{i+1}$) is calculated. Moreover, a target torque waveform is determined based on this target torque value ($t_{i+1}$) and the target torque waveform at time $t_i$ before the update. In the example shown in FIG. 3, the required torque waveform Treq, the target torque waveform Ttgt, and the maximum torque Tmax are updated at time t2 by executing step 100.

Next, it is determined whether the target torque value Ttgt ($t_{i+1}$) at time $t_{i+1}$, which is calculated in step 100, exceeds the maximum torque Tmax (step 102). In step 102, it is determined whether the target torque waveform Ttgt updated in step 100 is able to be realized by hardware control (e.g., throttle opening amount control and ignition timing control and the like).

If it is determined in step 102 that the target torque value Ttgt ($t_{i+1}$) does not exceed the maximum torque Tmax, it is determined that the target torque waveform Ttgt can be realized by hardware control. In this case (for example, when the internal combustion engine 1 is not required to produce a large amount of additional torque in a short time), the time at which the target torque waveform Ttgt is realized is not changed (step 112). In this case, the target torque waveform Ttgt updated in step 100 is realized by hardware control.

If, on the other hand, it is determined in step 102 that the target torque value Ttgt ($t_{i+1}$) exceeds the maximum torque Tmax, it is determined that the target torque waveform Ttgt cannot be realized by hardware control. In this case (for example, when the internal combustion engine 1 is required, to produce a large amount of additional torque in a short time), the target torque waveform Ttgt is delayed on the time axis, whereby time tb, at which the target torque value Ttgt ($t_{i+1}$) matches the maximum torque Tmax, is determined (step 104). In the example shown in FIG. 3, the target torque waveform Ttgt is delayed on the time axis, whereby time tb, at which the target torque value Ttgt (t2) matches the maximum torque Tmax, is determined by executing step 104.

Then, the delay time Δt from time ta at which the target torque waveform Ttgt updated in step 100 is realized until time tb at which the target torque waveform Ttgt delayed in step 104 is realized is calculated (step 106). In the example shown in FIG. 3, first, time tb, at which the target torque value Ttgt(t2) on the delayed target torque waveform Ttgt is achieved, is determined, and then the delay time from time ta until time tb is calculated by executing step 106.

Next, it is determined whether the delay time calculated in step 106 is less than a reference value $\Delta t_{th}$ (step 108). This reference value $\Delta t_{th}$ is set such that an unpleasant sensation will not be imparted to the driver if the delay time Δt is less than the reference value $\Delta t_{th}$. If it is determined in step 108 that the delay time Δt is less than the reference value $\Delta t_{th}$, it is determined that even if the time at which the target torque waveform Ttgt is realized is delayed until time tb, the difference between the target torque waveform Ttgt and the required torque waveform Treq on the time axis is within the allowable range so an unpleasant sensation is not imparted to the driver. In this case, the time at which the target torque waveform Ttgt is realized, more specifically, the time at which the target torque value Ttgt ($t_{i+1}$) is achieved, is changed from time ta to time tb (step 110).

If, on the other hand, it is determined in step 108 that the delay time Δt on the time axis exceeds the reference value $\Delta t_{th}$, it is determined that if the time at which the target torque waveform Ttgt is realized is delayed until time tb, the difference between the target torque waveform Ttgt and the required torque waveform Treq on the time axis falls outside the allowable range so an unpleasant sensation is imparted to the driver. In this case, the time at which the target torque waveform Ttgt is realized is prohibited from being changed to time tb (step 112). That is, a portion of the target torque waveform Ttgt updated in step 100 is realized by hardware control.

After step 100 or step 112 is executed, the value indicating time is incremented (step 114), after which this cycle of the routine ends.

When the next cycle (and the cycles thereafter) of this routine is started, the required torque waveform Treq, the target torque waveform Ttgt, and the maximum torque Tmax are updated based on the accelerator angle AA at incremented time $t_{i+2}$ (step 100). Then steps 102 to 114 are sequentially executed.

As described above, according to the routine shown in FIG. 4, when the target torque value Ttgt ($t_{i+1}$) on the updated target torque waveform Ttgt exceeds the maximum torque Tmax, the target torque waveform Ttgt is delayed on the time axis, and the time at which the target torque value Ttgt ($t_{i+1}$) is achieved is delayed until time tb. Accordingly, the target torque waveform Ttgt can be realized even if the internal combustion engine 1 is required to produce a large amount of additional torque in a short time. That is, the target torque waveform Ttgt accurately matches the required torque waveform Treq. Also, the delay time Δt between the time at which the updated target torque waveform Ttgt is realized and the time at which the delayed target torque waveform Ttgt is realized is calculated. If the delay time Δt exceeds the reference value $\Delta t_{th}$, the time at which the target torque waveform Ttgt is realized is prohibited from being delayed. As a result, it is possible to avoid a situation in which an unpleasant sensation is imparted to the driver of the vehicle.

In this example embodiment of the invention, a case is described in which the throttle opening amount control and the ignition timing control are employed as the hardware control executed to realize the target torque waveform. Instead of or in addition to these controls, fuel injection amount control and/or valve opening characteristics control (such as valve timing, operation angle, and lift amount control over the intake and exhaust valves 16 and 40) may also be executed. In this case as well, the same effects as those obtained with the foregoing example embodiment of the invention can be obtained.

Also, in this example embodiment of the invention, a case is described in which the torque rises. However, the invention may also be applied to a case in which the torque falls. In this case, the minimum torque Tmin, instead of the maximum torque Tmax, is updated in step 100 (see FIG. 3), and instead of the process in step 102, it is determined whether target torque value Ttgt ($t_{i+1}$) is less than the minimum torque Tmin. In this case as well, even if the internal combustion engine 1 is required to significantly decrease the torque production amount in a short time, the target torque waveform Ttgt can still be realized by delaying the time at which the target torque waveform Ttgt is realized.

Also, in this example embodiment of the invention, the time at which the target torque waveform Ttgt is realized is prohibited from being delayed based on the result of comparison between the delay time Δt and the reference value $\Delta t_{th}$. Alternatively, such delay may also be prohibited based on the result of comparison between a reference value and the difference between the required torque waveform Treq and the target torque waveform Ttgt on the time axis. More specifically, as shown in FIG. 3, time tc at which the target torque waveform Ttgt starts to rise may be determined, and then the time difference between time t1 and time tc may be obtained and compared with a predetermined reference value.

In this example embodiment of the invention, the internal combustion engine 1 functions as the internal combustion engine according to the invention, and the spark plug 12 and the throttle valve 26 function as the torque varying unit according to the invention. Also in this example embodiment of the invention, the ECU 60 functions as the target torque waveform updating unit according to the invention by executing the process in step 100. The ECU 60 also functions as the torque range determining unit according to the invention by executing the processes in steps 102 and 104. Moreover, the ECU 60 functions as the realization time delaying unit according to the invention by executing the process in step 110. The ECU 60 also functions as the delay time calculating unit according to the invention by executing the process in step 106. The ECU 60 also functions as the prohibiting unit according to the invention by executing the processes in steps 108 and 112.

While the invention has been described with reference to an example embodiment thereof, it is to be understood that the invention is not limited to the example embodiment or constructions. To the contrary, the invention is intended to cover various modifications and equivalent arrangements. In addition, while the various elements of the example embodiment are shown in various combinations and configurations, which are exemplary, other combinations and configurations, including more, less or only a single element, are also within the spirit and scope of the invention.

What is claimed is:

1. A control apparatus for an internal combustion engine, comprising:

torque varying means for changing torque output from the internal combustion engine;

target torque waveform updating means for updating a target torque waveform in response to an accelerator operation;

torque range determining means for determining a torque range that is a range of torque which can be achieved by the torque varying means; and realization time delaying means for delaying a time at which the target torque waveform is realized until the target torque waveform falls within the torque range, when the target torque waveform updated by the target torque waveform updating means falls outside the torque range.

2. The control apparatus according to claim 1, further comprising:

delay time calculating means for calculating a delay time that is a delay in the time at which the target torque waveform is realized; and prohibiting means for prohibiting the time at which the target torque waveform is realized from being delayed by the realization time delaying means, when the delay time falls outside a predetermined reference value.

3. A control apparatus for an internal combustion engine, comprising:

a torque varying unit that changes torque output from the internal combustion engine;

a target torque waveform updating unit that updates a target torque waveform in response to an accelerator operation;

a torque range determining unit that determines a torque range which is a range of torque that can be achieved by the torque varying unit; and a realization time delaying unit that delays a time at which the target torque waveform is realized until the target torque waveform falls within the torque range, when the target torque waveform updated by the target torque waveform updating unit falls outside the torque range.

4. The control apparatus according to claim 3, further comprising:

a delay time calculating unit that calculates a delay time that is a delay in the time at which the target torque waveform is realized; and a prohibiting unit that prohibits the time at which the target torque waveform is realized from being delayed by the realization time delaying unit, when the delay time exceeds a predetermined reference value.

5. A control method for an internal combustion engine, which controls torque output from the internal combustion engine, comprising:

setting a target torque waveform in response to an accelerator operation;

determining a torque range which is a range of achievable torque; and delaying a time at which the target torque waveform is realized until the target torque waveform falls within the torque range, when the set target torque waveform falls outside the torque range.

6. The control method according to claim 5, further comprising:

calculating a delay time that is a delay in the time at which the target torque waveform is realized; and prohibiting the time at which the target torque waveform is realized from being delayed when the delay time exceeds a predetermined reference value.

* * * * *